United States Patent [19]

Tagtow

[11] Patent Number: 4,868,939

[45] Date of Patent: Sep. 26, 1989

[54] FREE FLOATING BUNK BED

[76] Inventor: Jerald C. Tagtow, P.O. Box 217, Atwater, Minn. 56209

[21] Appl. No.: 275,118

[22] Filed: Nov. 22, 1988

[51] Int. Cl.[4] ..... A47C 19/00

[52] U.S. Cl. ..... 5/103; 5/118; 5/124; 5/412

[58] Field of Search ..... 5/103, 118, 101, 104, 5/124, 127, 129, 412, 244; 248/589, 591, 593, 618, 636

[56] References Cited

U.S. PATENT DOCUMENTS

| | | | |
|---|---|---|---|
| 1,957,005 | 5/1934 | Thum | 5/124 |
| 2,840,140 | 6/1958 | Harrington | 248/584 |
| 3,141,178 | 7/1964 | Campbell | 5/118 |
| 3,285,652 | 11/1966 | Coup | 296/24 |
| 3,298,043 | 1/1967 | Muller et al. | 5/118 |
| 3,371,359 | 3/1968 | Dome | 5/118 |
| 3,402,960 | 9/1968 | Erke | 296/23 |
| 3,524,673 | 8/1970 | Cramer et al. | 296/23 |
| 3,588,168 | 6/1971 | Froitzheim et al. | 296/28 |
| 3,612,599 | 10/1971 | Sternberg | 296/24 |
| 3,698,022 | 10/1972 | Knight | 5/118 |
| 3,760,436 | 9/1973 | Zach | 5/103 |
| 3,879,081 | 4/1975 | Hockley et al. | 296/28 |
| 3,882,558 | 5/1975 | Christensen | 5/118 |
| 4,107,797 | 8/1978 | Maxwell | 5/118 |
| 4,144,601 | 3/1979 | Anderson | 5/118 |
| 4,196,483 | 4/1980 | Lefler | 5/103 |
| 4,215,899 | 8/1980 | Schmidt et al. | 296/190 |
| 4,221,424 | 9/1980 | Eiserman et al. | 296/146 |
| 4,319,778 | 3/1982 | Leonard et al. | 296/166 |
| 4,443,034 | 4/1984 | Beggs | 296/65 R |
| 4,497,078 | 2/1985 | Vogel et al. | 5/118 |
| 4,603,900 | 8/1986 | Dodgen | 296/156 |

*Primary Examiner*—Gary L. Smith
*Assistant Examiner*—Flemming Saether
*Attorney, Agent, or Firm*—Kinney & Lange

[57] ABSTRACT

A free floating bunk bed includes a bed framework supported on a base framework which in turn is supported on a bed support floor of a truck or tractor cab. The base framework includes first and second subframes. The bed framework is supported on the base framework by a suspension means which includes two pairs of rigid hanger brackets each pair is pivotally mounted to a one of the suspension subframes. Hanger straps extend between the end of each hanger bracket and a portion of the bed framework spaced below the end of the hanger bracket, and two universal joints connect each hanger strap between the end of its hanger bracket and the bed framework. A pair of opposed and balanced compression coil springs are operative between the base framework and each pair of hanger brackets to tend to keep the hanger bracket from pivoting with respect to the base framework.

16 Claims, 5 Drawing Sheets

FREE FLOATING BUNK BED

BACKGROUND OF THE INVENTION

1. Field of the Invention

This invention has relation to a human support system to promote sleeping while in a moving structure, and more particularly, to a bed for use by an off duty driver while traveling in a cab of a truck or a semi-trailer tractor.

2. Description of the Prior Art

Large numbers of beds have been devised to allow truckers to rest while over-the-road vehicles are being driven by on duty drivers. A number of such structures have been patented.

A preliminary search was conducted on an early form of the present invention, and the following more or less pertinent patents were cited.

U.S. Pat. No. 4,144,601, granted on Mar. 20, 1979 to Anderson et al, discloses a bed in which the vertical shocks are taken up by air cushions and scissor legs. Fore and aft shocks in the direction of truck movement (transverse movement with respect to a person on the bed) are absorbed by movement of a top frame along a base frame to allow the top frame to come into contact with opposed compression coil springs. As seen in FIG. 5 of Anderson et al, axes of vertical movement and of movement on the longitudinal axis of the truck are provided. No provision is made to cushion against component of motion at right angles to the direction of the primary movement of the truck.

U.S. Pat. No. 4,497,078 granted on Feb. 5, 1985 to Vogel et al shows a bed wherein air bags and accumulators ar used to cushion fore and aft movement of the truck and other air bags and accumulators are used to cushion vertical movement. No provision is made for handling lateral or transverse shocks to the sleeping person.

U.S. Pat. No. 4,107,797 granted on Aug. 22, 1978 to Maxwell shows a bed with an intermediate frame which rolls in the fore and aft direction of truck movement on a base frame and is biased to tend to stay in a middle position when not stressed. Vertical movement of an upper pallet frame toward the intermediate frame is cushioned by a horizontally positioned shock absorber. There is no provision for absorbing motion transverse to the direction of movement of the truck.

U.S. Pat. No. 3,612,599 granted on Oct. 12, 1971 to Sternberg shows a bed in which a horizontal base frame is mounted on springs to take up the vertical shock. A horizontal intermediate frame is supported on rollers running on the base frame, and springs are positioned to absorb shocks due to fore and aft movement of the intermediate frame in the direction of movement of the truck. These opposed coil springs tend to center the pallet in front and rear direction of truck movement. No provision is made for absorbing side to side components of shock.

Of less pertinence are the following patents.

U.S. Pat. No. 3,524,673 granted on Aug. 19, 1970 to Cramer et al discloses a pallet supported on a base frame by eight generally horizontal springs between the pallet and the frame. Because the pallet must be supported in substantial clearing relationship with respect to the outer frame, and because the space for such beds in truck cabs is extremely limited, the size of the bed available to the sleeping trucker is quite limited. Also, since this Cramer structure was invented prior to Apr. 8, 1968 and has been patented since August of 1970, it has not been generally adopted to solve the problem which occasioned its development. For example, all of the prior art patents set out above, and many of the patents cited below, were developed and patented after the Cramer patent was part of the prior art. Neither the patent to Cramer nor any other prior art patent found general acceptance before the present invention.

U.S. Pat. No. 3,698,022 granted on Oct. 17, 1972 shows a more or less standard "Army cot" design supported on four posts by inclined tension coil springs. A vertical spring 42 or "shock absorber (dashpot)" extends from a horizontal bar to one of the pallet frame ends to absorb vertical shock movement. Because the conventional "generally rectangular section of wire mesh 9" comes right up to the sides and ends of the rectangular frame, there is little, if any, ability to absorb either fore and aft, or side to side components of shock.

U.S. Pat. No. 3,285,652 granted on Nov. 15, 1966 to Coup shows the use of rubber bands 20 to support a pallet frame on a base. Vertical tracks and rollers prevent fore and aft movement and make no provision for components of shock in side to side relation to movement of the truck along the highway.

U.S. Pat. No. 3,141,178 granted on July 21, 1964 to Campbell utilizes springs under a pallet to absorb vertical shock. Vertical guides 70 and rollers 74 resist any horizontal movement in fore and aft or side by side direction.

U.S. Pat. No. 3,882,558 granted May 13, 1975 to Christensen shows downward movement of a top pallet frame 30 with respect to a lower base frame 20 which causes drums 20 to rotate in opposite directions, the bottom surface of each drum moving toward that of the other. Shock absorber 50 is attached to lines 54 and 55 wrapped around the top of the drum surfaces, so shock absorber 50 cushions and limits downward movement of the pallet frame. There appears to be no provision to lessen shocks in directions fore and aft or side by side of truck movement.

U.S. patents cited during the search, but believed to be less pertinent include: U.S. Pat. Nos. 3,298,043 granted on Jan. 18, 1967 to Muller et al; 4,443,034 granted on Apr. 17, 1984 to Begs; 4,603,900 granted on Aug. 5, 1986 to Dodgen; 4,319,778 granted on Mar. 16, 1982 to Leonard et al; 3,402,960 granted on Sept. 24, 1968 to Erke; 3,588,168 granted on June 28, 1971 to Frotzheim et al; 3,879,081 granted on Apr. 22, 1975 to Hockley; 4,215,S99 granted on Aug. 5, 1980 to Schmidt et al; and 4,221,424 granted on Sept. 9, 1980 to Eiserman et al.

What was needed before the present invention was a truck bed suspension which would cushion a sleeping person against vertical shocks of truck or other vehicle movement, against components of shock in a horizontal direction whether those components were in line with the direction of movement of the truck, were transverse to the direction of movement of the truck, or were anywhere in between those directions; and which would give the feeling of "free floating" on a horizontal bed in space.

Neither the inventor nor those in privity with him are aware of any prior art closer than that discussed above; nor are they aware of any prior art which anticipates the claims herein.

SUMMARY OF THE INVENTION

A longitudinally extending bed for supporting a mattress in a generally horizontal plane within a moving structure includes a rigid longitudinally extending bed framework; a rigid longitudinally extending base framework fixedly supported with respect to a moving structure; suspension means pivotally mounted to the base framework for supporting the bed framework with respect to the base framework; and opposed resilient means operative between the base framework and the suspension means at opposite end portions of the bed to tend to keep the suspension means from pivoting with respect to the base framework, thus to absorb the shock of relative movement between the bed framework and the base framework and to tend to maintain the bed framework in vertically aligned relationship with respect to the base framework.

In the form of the invention as shown, the longitudinally extending bed framework and the longitudinally extending base framework are generally rectangular in configuration. The suspension means includes four rigid hanger brackets, each pivotally mounted at a first end thereof to one of the four outermost corner portions of the base framework on a horizontal axis transverse to the longitudinal axis of the bed, and each hanger bracket having a second end in spaced relation to the first end and above at least a portion of the bed framework; first and second hanger bracket tie bar means attached between a first pair of the four hanger brackets pivoted to the first suspension subframe and between a second pair of these four hanger brackets pivoted to the second subframe, respectively, so as to positively maintain the hanger brackets of each pair in parallel relation to each other; and hanger straps extending between the second end of each hanger bracket and a portion of the bed framework spaced below the second end of that hanger bracket.

There are eight universal joints, two connecting each hanger strap between the second end of its hanger bracket and the be framework. Equivalent to the rigid hanger straps and universal joints are flexible hanger straps each directly fastened to the second end of its hanger bracket and to a portion of the bed framework spaced below it.

The opposed and balanced resilient means operating between the base framework and the suspension means is constituted as a pair of compression coil springs each operative between the base framework and each coupled pair of hanger brackets. However, this resilient means could take the form of a pair of balanced and opposed springs or the like each operating in tension.

One specific form of the broad invention set out herein is of a free floating bunk bed for use behind the driver's seat of an over-the-road tractor pulling a semi-trailer. This bunk bed and other structures give a user the feeling of "free floating" because, when the base framework and vehicle are at rest, the ordinary movements of an occupant of the bed in any direction occasion an equal and opposite movement of the bed framework and mattress without the bed framework "colliding" with any other rigid part of the base framework.

DETAILED DESCRIPTION OF THE PREFERRED EMBODIMENTS

Figure 1:
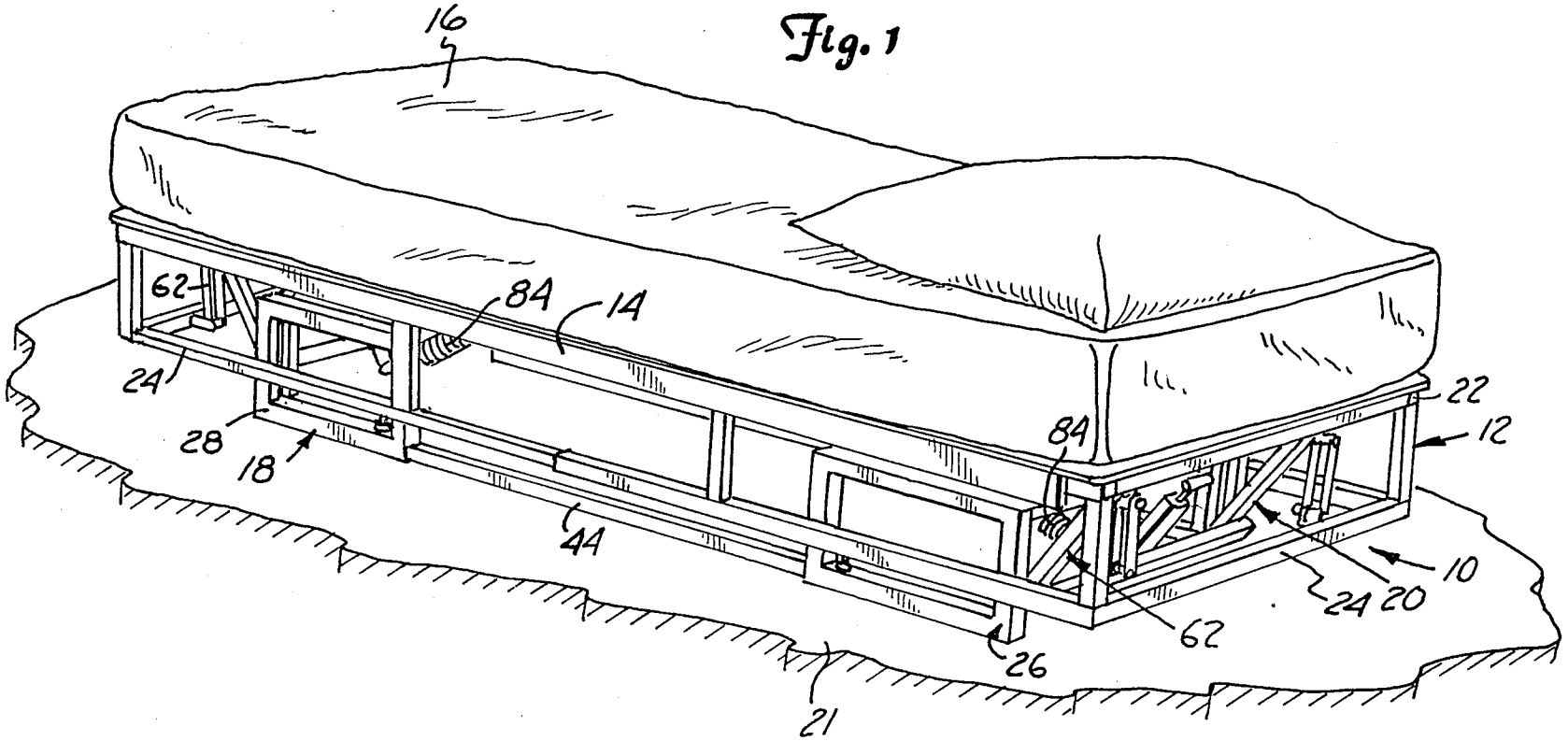
FIG. 1 is a perspective view of a longitudinally extending bed of the present invention supporting a pallet and mattress on a horizontal floor.

A longitudinally extending bed 10 is for supporting a mattress and/or pallet on a floor of a moving structure such as a truck or a car, a train, a boat or ship, or an aircraft or the like. Preferably the bed can be in transverse relation to the nominal longitudinal axis of movement of the structure. Bed 10 includes a rigid, generally rectangular, longitudinally extending bed framework 12 adapted to support a pallet 14 and/or a mattress 16. The bed framework 12 is supported on a rigid, generally rectangular, longitudinally extending base framework 18 through the instrumentality of a bed framework suspension means indicated generally at 20. The base framework 1B rests on a bed support floor 21, behind the driver's seat in the cab of a tractor pulling an over-the-road semi-trailer, for example.

Bed framework 12 includes an upper, rectangular, frame 22 for supporting a pallet or mattress and a lower, rectangular, base frame 24, riqidly supported with respect to the upper frame 22 and in parallel spaced relationship to it.

The base framework 18 includes a first base subframework 26 at a first end portion of the base framework and a second base subframework 28 at a second end portion thereof.

The upper, rectangular, pallet supporting frame 22 is made up of a pair of mutually parallel, longitudinally extending hollow tubes 30,30, square in the form of the invention as shown, and a pair of mutually parallel, transversely extending end tubes 32,32 rigidly connected between the ends of tubes 30 and 30.

The lower, rectangular, base framework supported frame 24 is made of a pair of mutually parallel, longitudinally extending, square tubes 34,34. A pair of mutually parallel, transversely extending end tubes 36,36 are integrally connected between the ends of tubes 34,34. Upper frame 22 and lower frame 24 are rigidly positioned in fixed parallel relationship to each other through the instrumentality of a plurality of vertical legs 38.

Figure 2:
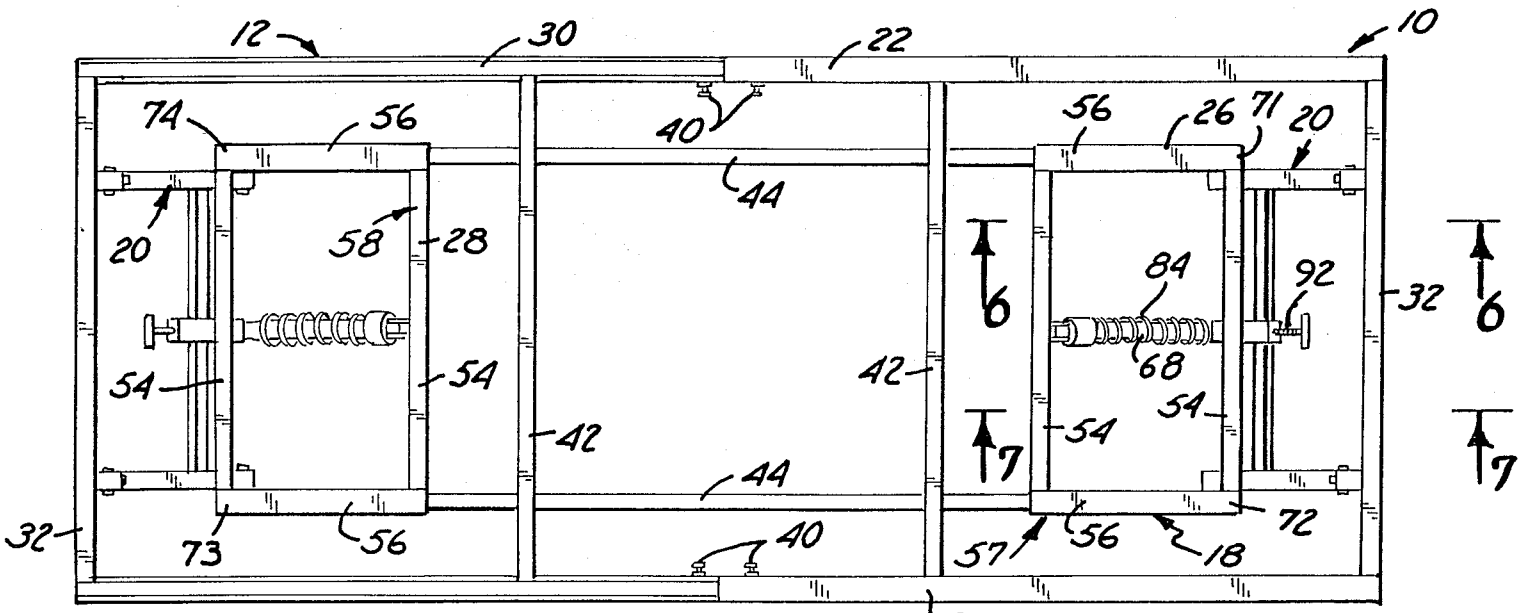
FIG. 2 is a top plan view of the bed of FIG. 1 with the mattress and pallet removed.
Figure 3:
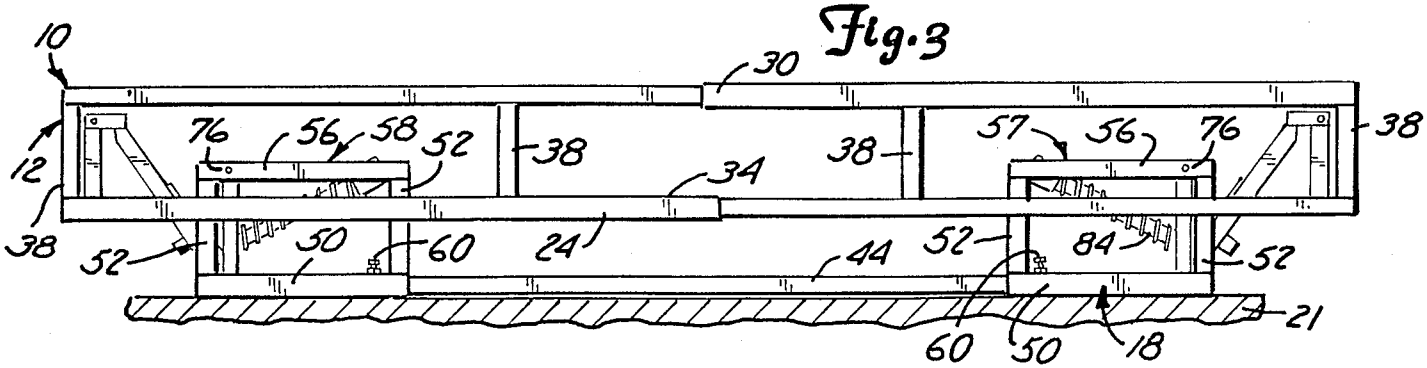
FIG. 3 is a side elevational view of the bed as seen in FIG. 2.
Figure 4:
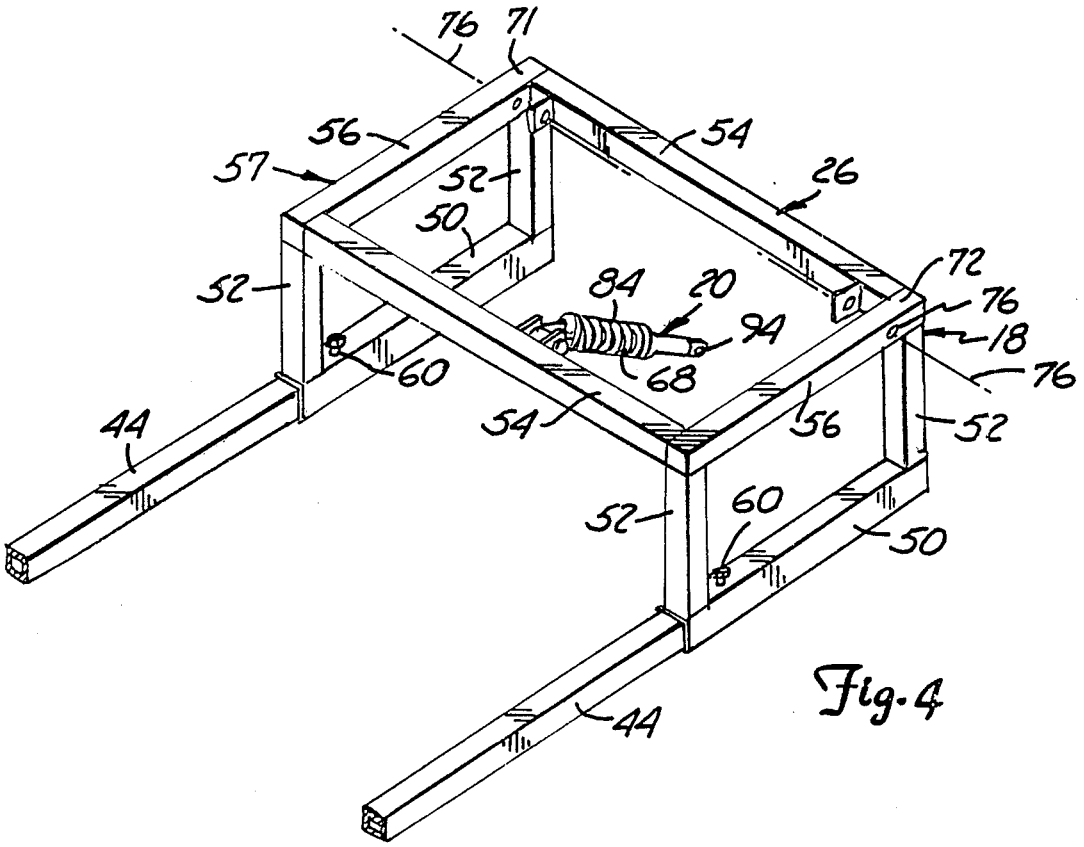
FIG. 4 is a fragmentary perspective view of a right end portion of a longitudinally extending base frame to be supported on a bed support floor and of a shock absorber connected to the base frame and forming part of a bed framework suspension means.
Figure 5:
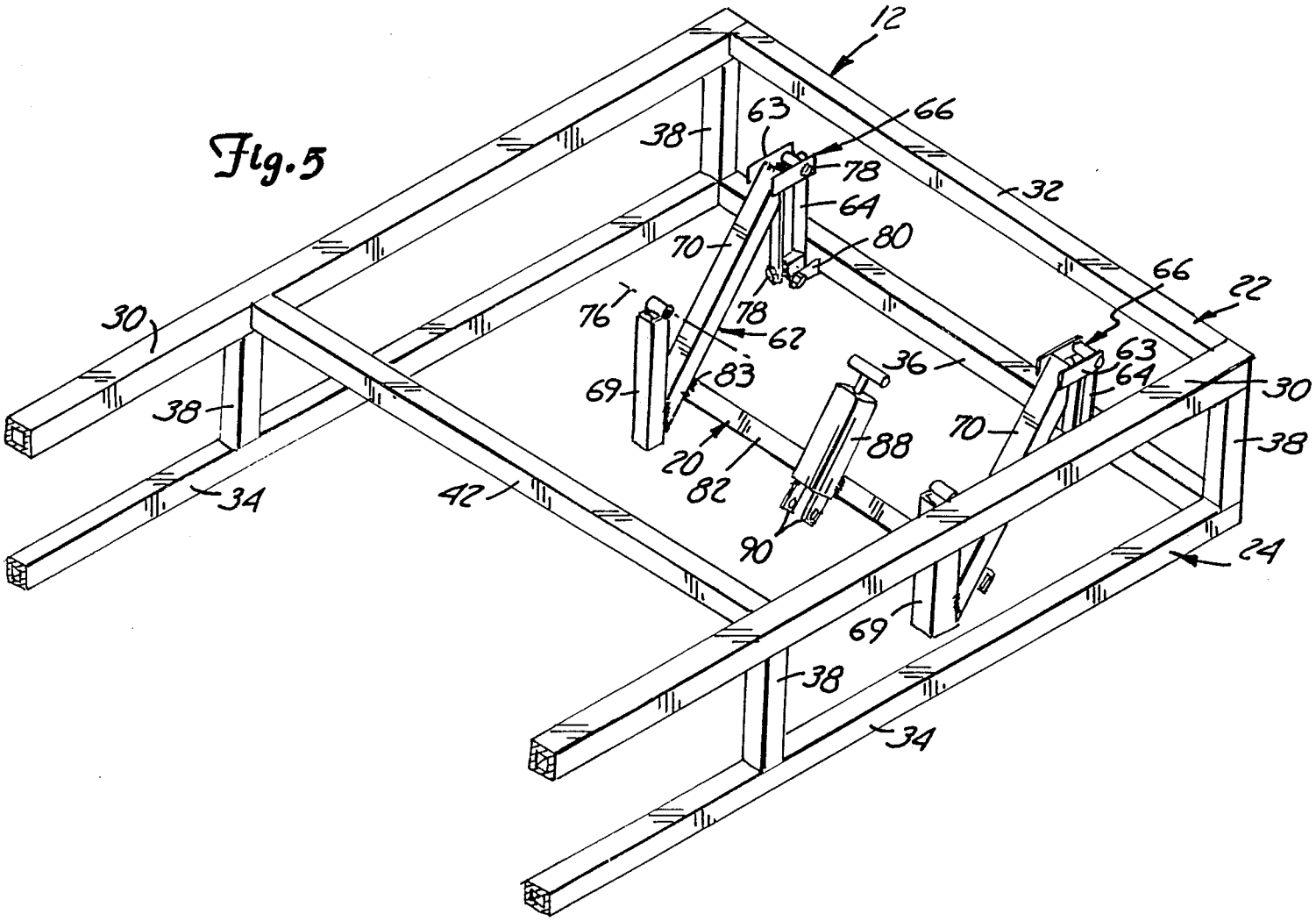
FIG. 5 is a fragmentary perspective view of a right end portion of a generally rectangular, longitudinally extending bed framework and of a first pair of hanger brackets, hanger bracket tie bar means, hanger straps and universal joints forming, with the shock absorber, a first half of the suspension means.

In order to make the end to end length of the bed framework 12 adjustable, in the form of the invention as shown, as best seen in FIG. 3, each of the longitudinally extending hollow tubes 30,30, and 34 and 34 is made in two pieces which can telescope with respect to each other. For example, the right-hand portion of tubes 30,30 as seen in FIGS. 2 and 3 can be of 1¼" square dimension while the left portion of those same tubes can be 1" square dimension to nest and telescope inside of the right-hand portion. Similarly, as most clearly shown in FIG. 3, the eft-hand side of the tubes 34,34 can be of 1¼" square tube stock while the right-hand portion of those same tubes can be of 1" tube stock. As best seen in FIGS. 2 and 5, appropriate bed framework set screws 40 can be threadably mounted through the larger tube portions so that the smaller tube portions can be held in place once the desired length of bed framework 12 has been attained.

For added support and dimensional stability, intermediate square spacer tubes 42,42 extend integrally between tubes 30,30 in parallel relationship to the end tubes 32,32.

The base framework 18 includes mutually parallel, longitudinally extending intermediate square connecting tubes between the first base subframework 26 and the second base subframework 28 of the base framework.

Each of these subframeworks 26 and 28 includes a pair of parallel, spaced-apart, hollow floor engaging runners 50,50; two pairs of vertical legs 52,52 extending upwardly from each end of each of the runners 50,50; a pair of transversely extending horizontal stringers 54,54 each integrally connected between the top ends of two of the transversely aligned legs 52; and two longitudinally extending tubes 56,56 integrally connected at each end to a junction of one of the legs 52 and stringers 54. The two longitudinally extending tubes 56,56 and transverse stringers 54,54 of each subframework 26 and 28 constitute suspension first and second subframes 57 and 58, respectively.

Open ends of the hollow runners 50,50 of the first subframework 26 and the second subframework 28 face toward each other, and, in the form of the invention as shown, each of these runners 50 can be of 1¼" stock while the connecting tubes 44,44 can be 1" square stock so that the subframes can be moved toward each other or away from each other until a desired end to end length of the base framework 18 is achieved. Then base framework set screws 60, threadably mounted in each of the runners 50, can be tightened up upon the connecting tubes 44,44 to fix that length. Set screws 60 are seen shown in FIGS. 3, 4, 6 and 7.

The bed framework suspension means 20 for supporting the bed framework 12 on the base framework lS includes four hanger brackets 62 pivotally mounted to the base framework, four hanger straps 64 depending from the four hanger brackets, universal joints or U-joints 66 connecting the hanger straps to the hanger brackets and connecting the bed framework to the hanger straps, and opposed resilient means such as the shock absorbers 6B pivotally mounted with respect to the base framework and with respect to the hanger brackets spaced from the base framework to tend to keep the hanger brackets from pivoting with respect to that base framework.

In the form of the invention as shown, four hanger brackets 62 are of an offset V-shape including a first vertical arm 69 and a second diagonal arm 70. A first end of each of the hanger brackets 62, at the top of the vertical arm 69, is pivotally mounted on a horizontal axis as at 76 to one of four outermost corner portions of the base framework 18 designated, respectively, 71, 72, 73 and 74.

Figure 8:
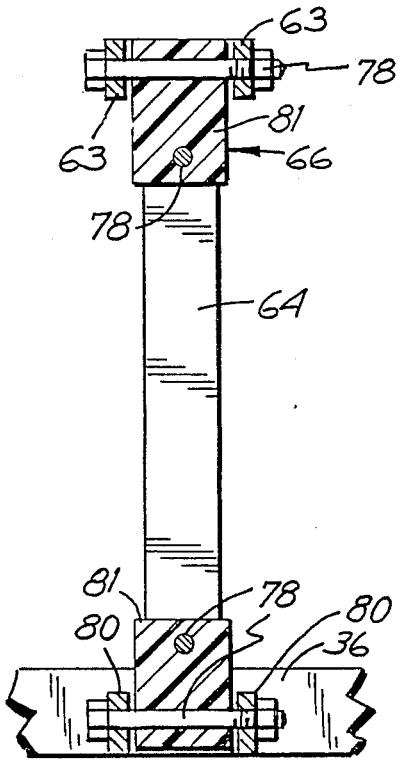
FIG. 8 is an enlarged vertical sectional view taken on the line 8—8 in FIG. 6.

A pair of ears 63 extend outwardly from a second end of each hanger bracket, at the top end of the diagonal arm 70. Each pair of such ears is pivotally mounted to one of the four hanger straps 64 through the instrumentality of one of a first four U-joints 66 and a pair of U-joint pivot bolts or pivot pins 78 as most clearly seen in FIG. 8. The bottom end of each of the four hanger straps is pivotally mounted to outer ends of the lower base framework supported frame 24 through the instrumentality of ears SO extending integrally inwardly from the transversely extending end tubes 36 of the lower bed framework 24, and through the instrumentality of one of a second four of U-joints 66.

While many different designs of U-joints could be used, solid nylon blocks 81 used in connection with U-joint pivot bolts 78 have been found to be very satisfactory.

The two hanger brackets 62 at each end of the bed are tied together so that they move in parallel relation to each other. This is accomplished through the use of hanger bracket tie bar means consisting of tie bars B2, one of which is welded or otherwise fastened between each pair of the hanger brackets as at S3.

Figure 7:
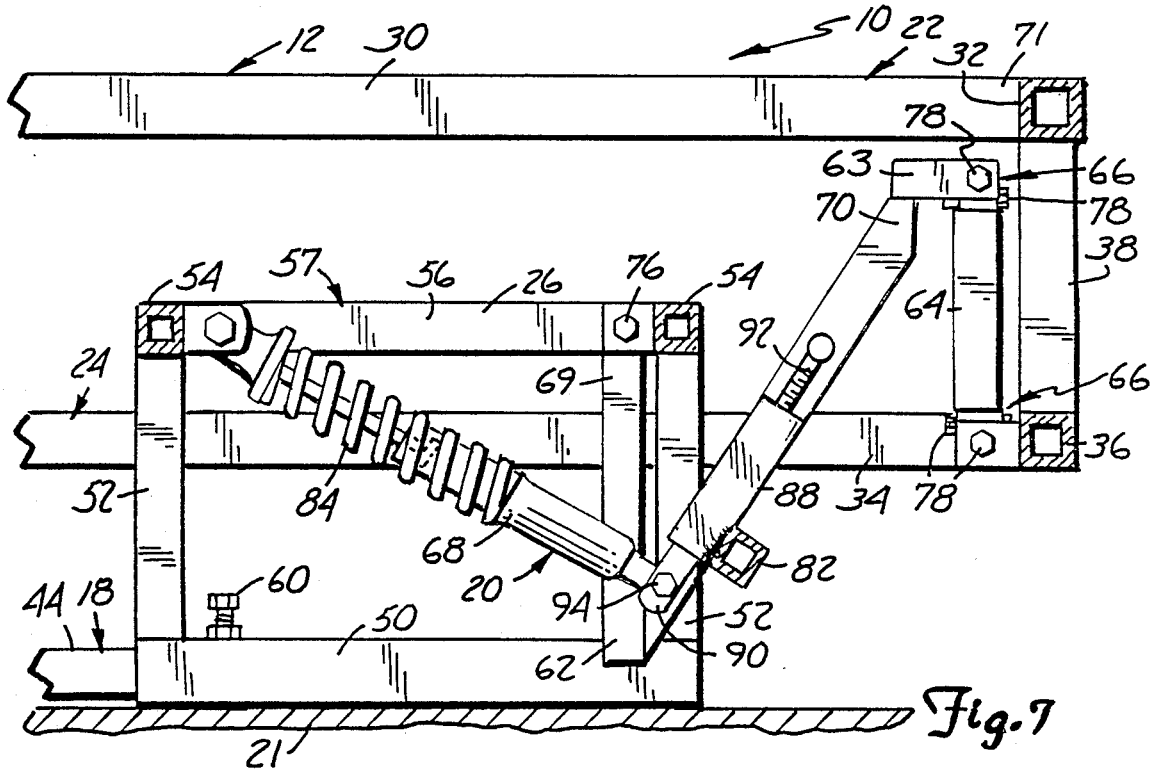
FIG. 7 is an enlarged vertical sectional view taken on the line 7—7 in FIG. 2.

To keep the bed framework 12 in balanced, vertically aligned position over the base framework 18, opposed balanced and resilient means acting generally between the bed frame and the base frame are used. In the form of the invention as shown, the opposed resilient means includes, at each end of the bed, a compression coil spring 84 exerting pressure between the transversely extending inwardly positioned horizontal stringer 54 of each of subframeworks 26 and 28 and a hanger bracket tie bar B2. With the force exerted by such coil springs equal or balanced, and with no weight on the bed and no movement of the bed support floor 21, the parts will take position as seen in FIG. 7, for example. In some instances, it may be advisable to use a pair of opposed, balanced resilient means acting in tension rather than in compression.

In a preferred form of the invention, the compression coil springs 84 forms parts of a shock absorbers 86. Shock absorbers S6 can be of any usual or preferred construction. It is preferred that they will be assembled in such a way that compression of the coil springs S4 will occur without interference resistance, but that the movement of the spring back toward fully extended positions will be inhibited by the usual shock absorbing action.

The compression coil springs S4 of the shock absorbers 68 can be preloaded to adjust the firmness of the bed in any usual or preferred manner.

The weight of the bed frame 12 and everything on it acts against the spring 84 of each shock absorber 68 on a lever arm extending at right angles to the longitudinal axis of the shock absorber and passing through the axes of those upper pivot bolts 78 supported by ears 63 of the hanger brackets 62. By increasing the length of that lever arm over that shown in FIG. 7, for example, more weight can be supported on the bed framework for one inch of compression of the spring 84; and by decreasing the length of that lever arm as shown, less weight is needed to compress the spring one inch. This change of the length of the lever arm is provided for by welding a camming box S8 to the hanger bracket tie bar 82 and mounting a pair of shock absorber support straps 90,90 to slide longitudinally with respect to the camming box. These support straps are moved up and down with respect to the box 88 through the instrumentality of threaded control rod 92 rotatably mounted with respect to the straps 90 and threadably mounted with respect to the camming box 88. Then by moving the support straps away from camming box 8S, the lever arm between upper pins 7S and the axis of a shock absorber 62 can be increased, allowing the spring to support more weight per inch of deflection. Movement in the opposite direction will reduce the lever arm length and make for an easier ride for a lighter user.

The mattress 16 is illustrated as lying on a pallet 14 which is supported by the bed framework 12 in FIG. 1. The specification and claims refer to a pallet supporting frame 22. It is to be understood that a mattress, a box spring, or anything else supporting a human form is considered as a pallet in the present context.

OPERATION

When a person lies on a mattress/pallet 16/14 supported by the longitudinally extending bed 1O, the bed framework 12 will tend to move down causing the hanger straps 64 to exert a force on the ears 63 of the second diagonal arm 70 of each hanger bracket 62 to tend to cause that bracket to pivot inwardly about horizontal pivot axes 76. See FIG. 6. This tendency of the hanger brackets to pivot inwardly will cause the compression coil springs B4 to be compressed until an equilibrium is reached between the force exerted by the spring and the force of the weight on the bed. With the bed support floor 21 at rest and with no movement on the part of the person on the bed, this equilibrium will not be disturbed.

However, as the bed support floor moves with in a tractor pulling a semi-trailer rig, for example, there will be intermittent heavy and sometimes violent motion of the bed support floor up and down as one or more of the tractor wheels go over ruts or into holes. This upward motion of the bed support floor 21 will have the same effect as an equal and opposite downward motion of the person in the bed, causing more or less violent and sudden compression of the spring 84. This spring compression serves to take up a good share of the shock which the "sleeper" would otherwise receive. As the tractor resumes a level ride, this energy stored in the spring will result in a corresponding upward movement of the bed framework 12. The dampening of this return upward movement by shock absorber action during return movement of the bed framework further softens the ride for the sleeper.

As pointed out above, a preferred location for the longitudinally extending bed 10 is in the available space between the driver's seat and the back wall of the tractor cab, putting the longitudinal axis of the bed at right angles to the longitudinal axis of movement of the rig down the highway. With the base framework 18 firmly on the bed support floor 21 and with the hanger brackets 62 all pivoted on horizontal axes 76 parallel with the longitudinal axis of the rig, any sudden forward or backward change of speed of the rig will be transmitted to the U-joints 66 at the upper ends of the hanger straps 64. But the hanger straps 64 support the bed framework 12 on the second end of the hanger brackets 62 through the instrumentality of upper and lower U-joints 66. It is the gravity or weight of the sleeper, mattress/pallet and bed framework which keeps the hanger straps 64 hanging substantially vertically below the upper ends of the diagonal arms 70 of the hanger brackets 62. Thus any sudden movements into the plane of the paper and away from the plane of the paper in FIGS. 6 and 7 cause a hammock-like swinging of the bed framework 12 to and from the plane of the paper in those figures. This hammock action serves to tend to dampen out these sudden base framework movement rate changes as far as the effect on the sleeper is concerned.

Figure 6:
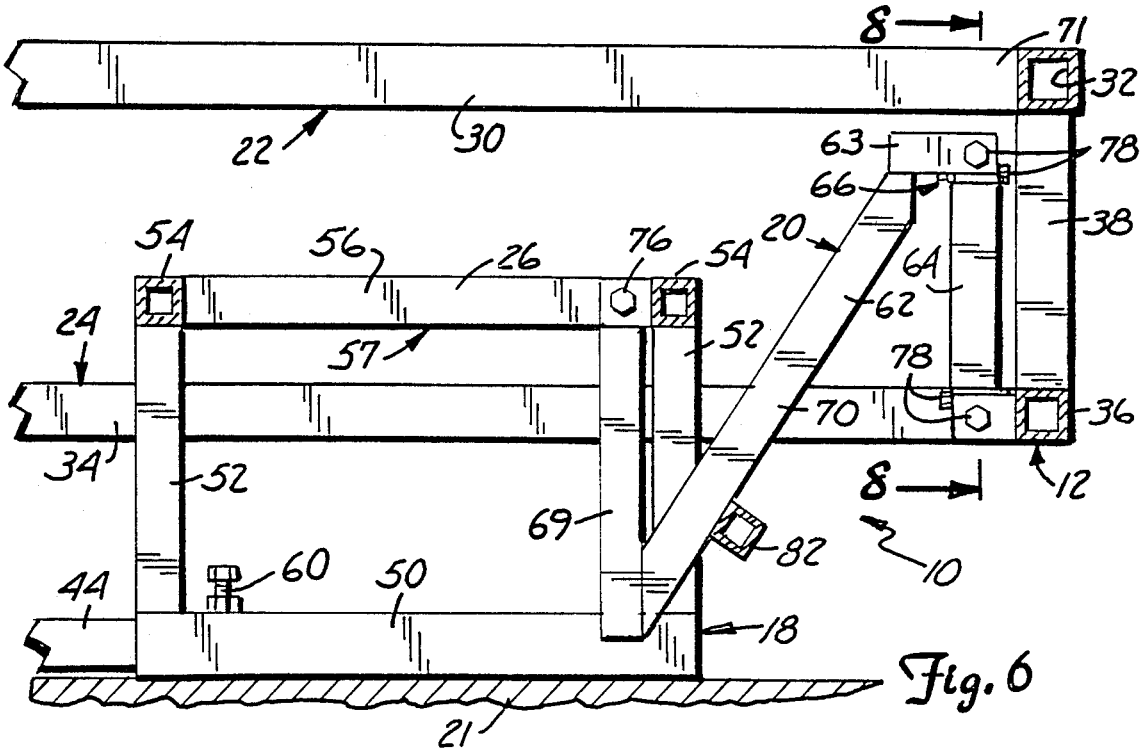
FIG. 6 is an enlarged vertical sectional view taken on the line 6—6 in FIG. 2.

Similarly, sudden lateral movement of the rig tends to be similarly damped out as the bed support floor 21 and base framework 18 move more or less laterally to and from right and left as seen in FIGS. 6 and 7. The bed framework and the sleeper will tend to remain in motion in the direction they are going, and the relative side to side movement of the bed frame with respect to the base frame will tend to be damped by the same hammock-like action.

Of course changes in the bumps and jumps do not come in purely forward and aft directions and in purely transverse side to side directions; and so the U-joints 66 are equally effective in damping out sudden changes in momentum in directions anywhere around a full 360°.

In the form of the invention as shown, fully rectangular shapes are disclosed for the purposes of clarity of illustration. Like all beds, however, while the generally rectangular shapes will be maintained, the edges of the bed framework and perhaps even of the base framework can be rounded to minimize the chances for people using the bed to crack into strictly rectangular corners when getting in and out of bed.

Likewise, while the base framework is shown resting on a horizontal bed support floor inside of the outer edges of the bed framework, it is to be understood that this base framework could be fixedly supported in a vehicle from above to have horizontal relationship with respect to the general orientation of the vehicle while in motion.

Although the present invention has been described with reference to preferred embodiments, workers skilled in the art will recognize that changes may be made in form and detail without departing from the spirit and scope of the invention.

What is claimed is:

1. A longitudinally extending bed for supporting a mattress with respect to a generally horizontal bed support floor of a moving structure, the bed including:

a. a rigid, generally rectangular, longitudinally extending bed framework;

b. a rigid, generally rectangular, longitudinally extending base framework supported with respect to the bed support floor and including a pair of coplanar, rigid, generally rectangular, horizontally disposed, suspension subframes in spaced relation to the bed support floor, a first subframe at a first end portion and a second subframe at a second end portion of the base framework, and each subframe having two outermost corner portions;

c. suspension means supporting said bed framework on said base framework, said suspension means including:

(1) four rigid hanger brackets, each pivotally mounted at a first end thereof to one of the four outermost corner portions of the suspension subframes on a horizontal axis transverse to the longitudinal axis of the bed, and each hanger bracket having a second end in spaced relation to the first end and above at least a portion of said bed framework, (2) first and second hanger bracket tie bar means rigidly attached between a first pair of hanger brackets pivoted to the first suspension subframe and between a second pair of hanger brackets pivoted to the second subframe, respectively, so as to positively maintain the hanger brackets of each pair in parallel relation to each other, (3) hanger straps extending between the second end of each hanger bracket and a portion of the bed framework spaced below the second end of that hanger bracket, and (4) eight universal joints, two connecting each hanger strap between the second end of its hanger bracket and the bed framework; and d. opposed and balanced resilient means attached to be operative between first points on the base framework and second points on each pair of hanger brackets spaced from the third points of pivotal mounting of the hanger brackets to the suspension subframes to tend to keep the hanger brackets from pivoting with respect to the base framework to absorb the shock of relative movement between the bed framework and the base framework and to tend to maintain the bed framework in vertically aligned relationship with respect to the base framework.

2. The bed of claim 1 wherein:

e. the opposed resilient means include compression coil springs operative between a first end portion of the base frame and the first pair of hanger brackets, and between a second end portion of the base frame and the second pair of hanger brackets, respectively.

3. The bed of claim 2 wherein:

f. the opposed resilient means includes shock absorbers encompassed by the compression coil springs.

4. The bed of claim 3 wherein:

g. the shock absorbers are assembled to the base frame and the suspension means in position such that compression of the coil springs due to movement of the bed framework downward with respect to the base framework and bed support floor is uninhibited by shock absorber action and motion of the bed framework upward with respect to the base framework and the floor is inhibited by shock absorbing action.

5. The bed of claim 4 wherein:

h. means is provided for varying the nominal length of the two shock absorbers between their end suspension points to control the preloading of the compression coil springs.

6. The bed of claim 1 wherein:

e. the universal joints each include two pivot pins situated on horizontal axes, vertically spaced in transverse relationship to each other, and a nylon block in encompassing, weight bearing relationship with respect to such pins.

7. The bed of claim 1 wherein:

e. means is provided to adjust the distance between the second points of resilient means attachment and the third points of hanger bracket pivotal attachment to the suspension subframes.

8. A longitudinally extending bed for supporting a mattress on a generally horizontal bed support floor of a moving structure, the bed including:

a. a rigid, generally rectangular, longitudinally extending bed framework;

b. a rigid, generally rectangular, generally horizontal, longitudinally extending base framework supported on the bed support floor in surrounded relationship with respect to the bed framework, said base framework including a pair of coplanar, rigid, generally rectangular, horizontally disposed, suspension subframes in spaced relation to the bed support floor, a first subframe at a first end portion and a second subframe at a second end portion of the base frame, each subframe having two outermost corner portions;

c. suspension means supporting the bed framework on the base framework, said suspension means including:

(1) four rigid hanger brackets, each pivotally mounted at a first end thereof to one of the four outermost corner portions of the suspension subframes on a horizontal axis transverse to the longitudinal axis of the bed, and each hanger bracket having a second end in spaced relation to and extending outwardly from the first end in position above at least a portion of the bed framework, (2) first and second hanger tie bars first pair of hanger brackets pivoted to the first suspension subframe and between a second pair of hanger brackets pivoted to the second subframe, respectively, (3) hanger straps extending down between the second end of each hanger bracket and a portion of the bed framework spaced below the second end of that hanger bracket, and (4) eight universal joints, two connecting each hanger strap between the second end of its hanger bracket, and the bed framework; and d. balanced and opposed resilient means operative between the base framework and portions of the suspension means at each end portion of the bed spaced vertically from the pivot points of the hanger brackets to the suspension subframe to tend to keep the hanger brackets from pivoting with respect to the base framework to absorb the shock of relative movement between the bed framework and the base framework and to tend to maintain the bed framework in vertically aligned, encompassing relationship above the base framework.

9. The bed of claim 8 wherein:

e. the opposed resilient means include compression coil springs operably connected between a first end portion of the base frame and the first pair of hanger brackets, and between a second end portion of the base frame and the second pair of hanger brackets, respectively.

10. The bed of claim 9 wherein:

f. the opposed resilient means includes shock absorbers encompassed by the compression coil springs.

11. The bed of claim 10 wherein:

g. the shock absorbers are assembled to the base frame and the suspension means in position such that compression of the coil springs due to movement of the bed framework downward with respect to the base framework and bed support floor is uninhibited by shock absorber action and motion of the bed framework upward with respect to the base framework and the floor is inhibited by shock absorbing action.

12. The bed of claim 11 wherein:

h. means is provided for varying the nominal length of the two shock absorbers between their end suspension points to control the preloading of the compression coil springs.

13. The bed of claim 9 wherein:

e. the universal joints each include two pivot pins situated on horizontal axes, vertically spaced in transverse relationship to each other, and a nylon block in encompassing, weight bearing relationship with respect to such pins.

14. The bed of claim 9 wherein:

f. adjustable connecting means is provided between the coil springs and the hanger brackets, said connecting means being adjustable to position the effective connection of the springs to the suspension means at various vertical distances from the axes of the hanger bracket pivot points to the suspension subframes, thus to change the perpendicular distance from the coil spring axes to such hanger bracket/suspension subframe pivot points.

15. A longitudinally extending bed for supporting a mattress in a generally horizontal position with respect to a moving structure, the bed including:

a. a rigid longitudinally extending bed framework;

b. a rigid, longitudinally extending base framework fixedly supported with respect to a moving structure and including a pair of coplanar, rigid, generally horizontally disposed suspension subframes, a first subframe at a first end portion and a second subframe at a second end portion of the base framework, and each subframe having two outermost corner portions;

c. suspension means supporting said bed framework with respect to said base framework, said suspension means including:

(1) four rigid hanger brackets, each pivotally mounted at a first end thereof to one of the four outermost corner portions of the suspension subframes on a horizontal axis transverse to the longitudinal axis of the bed, and each hanger bracket having a second end in spaced relation to the first end and above at least a portion of said bed framework, (2) first and second hanger bracket tie bar means rigidly attached between a first pair of hanger brackets pivoted to the first suspension subframe and between a second pair of hanger brackets pivoted to the second subframe, respectively, so as to positively maintain the hanger brackets of each pair in parallel relation to each other, and (3) hanger straps extending between the second end of each hanger bracket and a portion of the bed framework spaced below the second end of that hanger bracket; and d. opposed and balanced resilient means attached to be operative between first points on the base framework and second points on the suspension means spaced vertically from the third points of pivotal attachment of the hanger brackets to the suspension subframes at each end portion of the bed to tend to keep the hanger brackets from pivoting with respect to the base framework, thus to absorb the shock of relative movement between the bed framework and the bas framework and to tend to maintain the bed framework in vertically aligned relationship with respect to the base framework.

16. The bed of claim 15 wherein:

e. adjustable attachment means is provided to attach the resilient means to the suspension means, said attachment means being adjustable to position the effective line of action between the first and second points of attachment at various positions such that there can be any one of various perpendicular distances from said line of action to the third point of pivotal attachment of the hanger brackets and the suspension subframes.

* * * * *

UNITED STATES PATENT AND TRADEMARK OFFICE

CERTIFICATE OF CORRECTION

PATENT NO. : 4,868,939

DATED : September 26, 1989

INVENTOR(S) : Jerald C. Tagtow

It is certified that error appears in the above-identified patent and that said Letters Patent is hereby corrected as shown below:

Column 10, line 20, after "tie bars" insert --rigidly attached between a--.

Column 12, line 23, delete "bas" and insert therefor --base--.

Signed and Sealed this

Third Day of April, 1990

*Attest:*

HARRY F. MANBECK, JR.

*Attesting Officer*

*Commissioner of Patents and Trademarks*